US006523722B1

(12) United States Patent
Clark et al.

(10) Patent No.: US 6,523,722 B1
(45) Date of Patent: Feb. 25, 2003

(54) FOR AEROSOL AND PUMPSPRAY CONTAINERS WHICH CAN BE LOCKED INTO A NON-OPERATIVE POSITION

(75) Inventors: Norman Clark, Leeds (GB); Ian Midgley, Leeds (GB)

(73) Assignee: Helene Curtis, Inc., Chicago, IL (US)

( * ) Notice: Subject to any disclaimer, the term of this patent is extended or adjusted under 35 U.S.C. 154(b) by 25 days.

(21) Appl. No.: 09/219,023

(22) Filed: Dec. 23, 1998

(30) Foreign Application Priority Data

Dec. 24, 1997 (GB) ..... 9727366

(51) Int. Cl.[7] ..... B67D 5/33
(52) U.S. Cl. ..... 222/153.14; 222/402.11
(58) Field of Search ..... 222/402.11, 153.14

(56) References Cited

U.S. PATENT DOCUMENTS

| | | | | |
|---|---|---|---|---|
| 2,678,147 A | | 5/1954 | Abplanalp et al. | 222/545 |
| 3,185,350 A | | 5/1965 | Abplanalp et al. | 222/182 |
| 3,325,054 A | | 6/1967 | Braun | |
| 3,484,023 A | | 12/1969 | Meshberg | 222/402.11 |
| 3,591,128 A | | 7/1971 | Ramis | |
| 3,734,354 A | | 5/1973 | Gach | 222/153 |
| 3,744,682 A | | 7/1973 | Blank et al. | |
| 3,797,705 A | | 3/1974 | Cooprider | 222/153 |
| 3,848,778 A | * | 11/1974 | Meshberg | |
| 3,967,760 A | * | 7/1976 | Marcon | 222/153.14 |
| 4,024,988 A | | 5/1977 | Starrett | 222/153 |
| 4,324,351 A | | 4/1982 | Meshberg | |
| 4,542,837 A | | 9/1985 | Rayner | 222/402.11 |
| 4,773,567 A | * | 9/1988 | Stoody | 222/153 |
| 5,388,730 A | | 2/1995 | Abbott et al. | 222/153 |
| 5,649,645 A | * | 7/1997 | Demarest et al. | 222/153.07 |
| 5,971,230 A | * | 10/1999 | Tanaka | 222/402.11 |

FOREIGN PATENT DOCUMENTS

| | | | |
|---|---|---|---|
| EP | 119084 | * | 9/1984 |
| EP | 409 497 | | 1/1991 |
| EP | 503735 | * | 9/1992 |
| FR | 2310282 | | 12/1976 |
| FR | 2 695 379 | | 3/1994 |
| JP | 5285428 | | 2/1993 |

OTHER PUBLICATIONS

International search report No. PCT/EP 98/08151 to Kobayashi et al Dated 1/91.*
European Search Report in an EP application EP 01 12 8984.
Abstract of EP 01 12 8984.

* cited by examiner

*Primary Examiner*—Philippe Derakshani
(74) *Attorney, Agent, or Firm*—Kevin J. Stein

(57) ABSTRACT

A sprayhead for example for an aerosol or pumpspray container comprises a support, a fluid outlet mounted on the support, a passageway connected to the fluid outlet at a first end and connectable to a fluid source at a second end, the passageway being movable between a first non-operative position and a second position in which, in use, it is connected to a fluid source such that fluid can pass through the passageway to the fluid outlet, a member secured relative to the support, the member being movable between a non-operative position and a further position in which it allows the passageway to attain its second position, and a lock selectively operable to lock the member in its first position, thereby preventing the member from urging the passageway to its second position unless the lock is released.

25 Claims, 2 Drawing Sheets

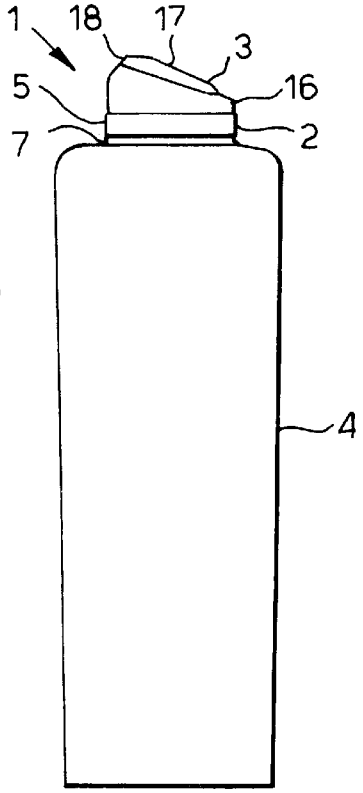
Fig.1.
Fig.2.
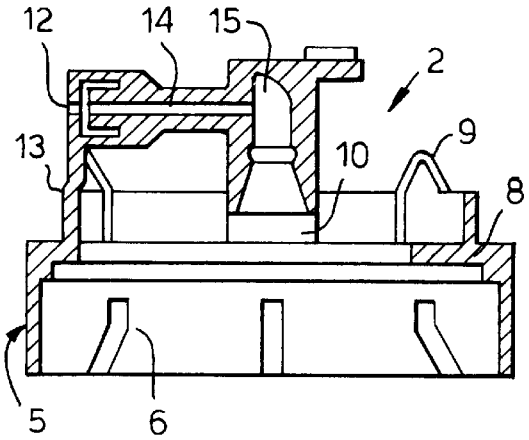
Fig.3.
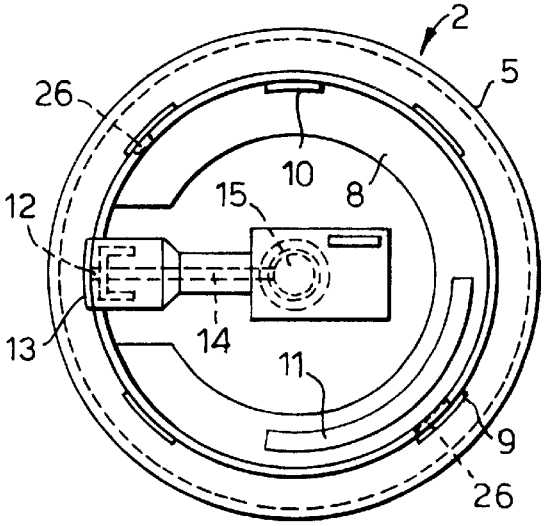

FOR AEROSOL AND PUMPSPRAY CONTAINERS WHICH CAN BE LOCKED INTO A NON-OPERATIVE POSITION

FIELD OF THE INVENTION

The invention relates to a sprayhead, and particularly, though not exclusively to a sprayhead for use with aerosol or pumpspray containers.

BACKGROUND

Aerosol containers contain fluid under pressure and a sprayhead is attached to the top of the container. Similarly, pumpspray containers typically contain fluid which is not pressurised, but which can be dispensed with the aid of a suitable pumpspray mechanism via a sprayhead. In both cases, when the sprayhead is depressed, the fluid in the container is forced out through an outlet in the sprayhead and the fluid spray is released. However, known sprayheads for use on either type of spray container are vulnerable to accidental operation, and it is normally necessary for a lid to be provided to prevent accidental release of the fluid.

An alternative means of prevent accidental release of fluid aerosol containers is disclosed in GB 1292843, U.S. Pat. Nos. 5,388,730, 4,418,842, 3,860,149, and 3,848,778. In those specifications, the sprayhead is rotatable about the supply line from the fluid reservoir within the container. In one position, the sprayhead can be depressed to enable the contents to be discharged, but after rotation around the axis of the supply line, depression of the sprayhead is physically obstructed, thereby preventing discharge. Continued rotation of the sprayhead relative to the supply line at their interface causes wear and can result in leakage of the contents at the interface and impaired operation of the aerosol.

SUMMARY OF THE INVENTION

The invention provides a sprayhead comprising:

a support;

passageway, mounted on the support, connectable to a switchable source of fluid and incorporating a fluid outlet, the passageway being moveable between a first, non-operative position and a second position in which it switches the source to supply fluid to the outlet via the passageway;

a member secured relative to the support, the member being moveable between a first non-operative position when the member is supported by a cam means on the support, and a further position in which the passageway may switch the source to supply fluid; and a lock selectively operable to lock the member in its first position, thereby preventing the member from urging the passageway to its second position unless the lock is released.

Preferably, when the member secured relative to the support is in the further position at which the fluid may be supplied, when activated the member depresses to actuate (in the case of a pressurised aerosol) a valve on the pressurised aerosol, thereby allowing fluid to pass through the passageway. In the case of a pumpspray, similar activation may cause actuation of the pumpspray mechanism to allow fluid to pass through the passageway.

Conveniently, the movement of the passageway is in a plane normal to longitudinal axis of a valve connector which may be located adjacent to, and in fluid connection with the passageway. The longitudinal axis of the valve connector may be coaxial with a radial axis of the sprayhead.

Conveniently, the movement of the member secured relative to the support may be rotational, about a radial axis of the sprayhead.

Preferably the fluid outlet is mounted on the support via a living hinge which is resiliently biased to urge the passageway to its first non-operative position. Such a position may allow (in the case of attachment to a pressurised aerosol) the valve on the aerosol container to be closed when a depression force is removed from the member; hence it is biased in the non-depressed position.

Preferably the member is mounted on the support via a living hinge which is resiliently biased to urge the member to its non-operative (ie non-depressed) position.

Advantageously the member shields the passageway such that the fluid may only be expelled from the passageway by movement of the member to the operative position.

Preferably the support comprises a base and a top, the base being mountable on a fluid container and the top being mounted on the base. Advantageously the member is integrally formed with the top of the support. Alternatively to a base and a top, the support can comprise a base and a collar, the base being mountable on a fluid container and the collar being mounted around the base. In such supports, the member is advantageously integrally formed with the base above the passageway.

Advantageously, the lock comprises complementary cam means on the base and the topor collar such that movement of the top or collarrelative to the base moves the corresponding cam means relative to one another between a first position in which the member is retained in its inoperative position and a second position in which the member can be moved to urge the passageway to its second (operative, dispensing) position.

Advantageously the top or collar is rotatable relative to base. Especially desirably, the base and particularly the passageway is not rotable axially relative to a fluid supply means from the fluid reservoir, such as the stem outlet from the supply valve, thereby avoiding wear at an interface between the fluid passageway in the sprayhead and the stem outlet which could arise if the passageway were able to rotate axially around the stem outlet.

Preferably the cam means comprises one of a cam profile and a cam follower on the base and the other of a cam profile or cam follower on the top or collar. Advantageously the cam means on the base comprises a cam profile and the cam means on the top comprises a cam follower on the member or cam means on the collar comprises a cam follower.

Preferably the base comprises plastics material and is moulded in one piece. Preferably the top comprises plastics material and is moulded in one piece. Preferably the collar is moulded in one piece. Advantageously the top or collar and base comprise co-operating fastening means that snap fit together.

Preferably the top comprises a body portion and the member comprises a cut-away portion linked to the body portion by a flexible hinge.

Advantageously the member comprises catch means to prevent raising of the member with respect to the body portion of the top.

Advantageously the top comprises an opening in the body portion for co-operation with the fluid outlet.

Advantageously, the base diameter is larger than the top diameter, to allow the sprayhead to be placed efficiently onto the container.

When a collar is employed instead of a top, the base preferably comprises a body portion attached to the member, and the collar preferably comprises an opening for cooperation with the fluid outlet.

Advantageously, one of the base and topor collar further comprises an indentation in its external face extending away from the boundary between the base and top or collar, and the other of the base and top or collar further comprises a tongue which fits the indentation, thereby preventing rotation of the topor collar relative to the base when the tongue is in place within the indentation. The tongue is desirable hinged such that it can be lifted out of the indentation, and preferably, the tongue is moulded in one piece with the respective top or bottom. The tongue and indentation and are preferably disposed relative to each other around their respective circumferences such that when they are in alignment, the member is locked in its first position, ie preventing the member from urging the passageway to its second position and the fluid outlet is covered by the top. Particularly, the tongue extends downwardly from the top and the base carries the indentation.

It is an advantage of the present invention that it provides a sprayhead for an aerosol, pumpspray or similar container that can be moved between an operable and an inoperable state.

The invention also resides in a container, especially an aerosol or pumpspray fluid container, including a spray head as defined hereinabove.

The invention will now be described, by way of example only, with reference to the accompanying drawings, of which:

BRIEF DESCRIPTION OF THE DRAWINGS

FIG. 1 shows a side view of a sprayhead according to the invention mounted on a fluid container;

FIG. 2 shows the base of the sprayhead shown in FIG. 1 in cross section;

FIG. 3 shows the base of the sprayhead in plan view;

DETAILED DESCRIPTION OF THE INVENTION

Figure 4:
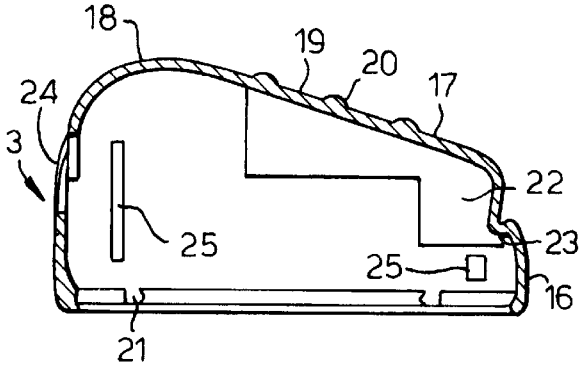
FIG. 4 shows the top of the sprayhead shown in FIG. 1 in cross section.

As shown in FIG. 1, a sprayhead 1 of the invention comprises a base 2 and a top 3 fixedly mounted on the base 2. The sprayhead 1 is shown mounted on an aerosol container 4, this being the normal manner of use of the sprayhead.

Referring also to FIGS. 2 and 3, the base 2 comprises a skirt portion 5 which includes moulded snap-fit segments 6 for connectably mounting the base 2 onto a neck 7 of the container 4. The container has protruding (but not shown) a stem piece through which fluid contained in the aerosol container may be released.

A plate section 8 is formed at the top of the skirt portion 5 and snap-fit segments 9 are formed integrally with the plate section 8 for fastening the base 2 to the top 3. An outlet closure plate 10 and a cam profile 11 are also formed on the plate section 8.

A fluid outlet 12 is formed in a plate 13 extending upwards from the skirt portion 5. A passageway 14 extends from the fluid outlet 12 to a valve connector 15 arranged centrally in the base 2 for fluid engagement via the stem piece with a valve connected to a pipe extending into fluid in the aerosol can (not shown). The valve connector 15 and passageway 14 can be depressed downwardly and are of sufficient resilience to return to a rest position when the depressing force is removed.

Figure 5:
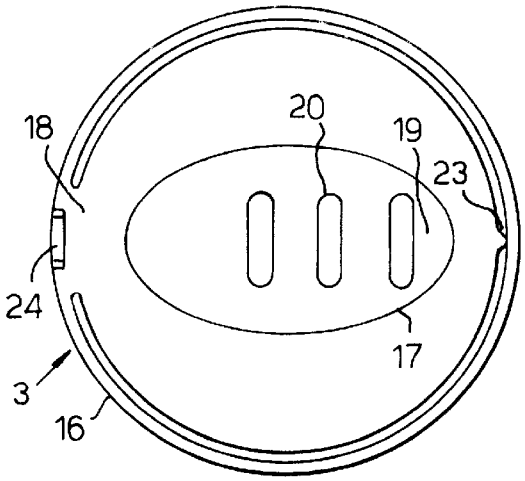
FIG. 5 shows the top of the sprayhead in plan view.

Referring now to FIGS. 4 and 5, the top 3 comprises a single integral moulding comprising a body portion 16 and a depressor member 17 connected to the body portion 16 by an integral flexible hinge portion 18. The depressor member 17 has a finger pad 19 sized for comfortable fit with a user's finger (not shown) and having ridges 20 to reduce the likelihood of a user's finger slipping during use of the sprayhead 1. The top 3 further includes snap-fit segments 21 for co-operation with the snap-fit segments 9 of the base 2 and a cam follower 22 for co-operation with the cam profile 11 formed on the base 2. A protuberance 23 restricts the depressor member 17 from being raised above the body portion 16 and an opening 24 corresponds to the fluid outlet 12.

Figure 6:
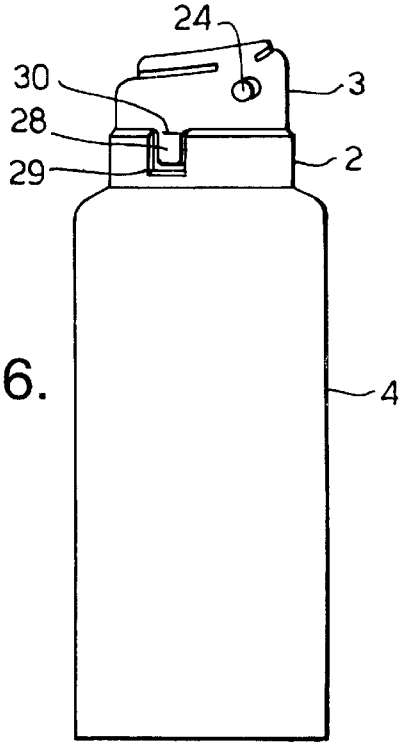
FIG. 6 shows a further side view of the spray head mounted on a fluid container

Referring now to FIG. 6, the base 2 is cut away to provide an indentation 29 in which sits a fitting tongue 28 extending down from and moulded with top 3. Tongue 28 is joined with top 3 at hinge 30. The opening 24 is not aligned with fluid outlet 12, so that it cannot be seen in this figure.

In use, the top 3 is snap-fitted to the base 2 and the complete sprayhead 1 is mounted on an aerosol container 4. Tongue 28 is pivoted about hinge 30 and lifted out of indentation 29. The depressor member 17 is pressed down by a user's finger, pushing the valve connector 15 down to contact the valve (not shown) in the aerosol container 4 and allow fluid to flow through the passageway 14 and out of the fluid outlet 12 as a spray. When the depressor member 17 is released, the depressor member 17 returns to its rest position and the valve connector 15 and passageway 14 return to their rest position, thus shutting off the flow of fluid.

To prevent inadvertent activation of the sprayhead 1, the top 3 can be rotated relative to the base 2 around the snap fittings 9 on the plate 8. As the top 3 is rotated, the cam follower 22 moves to a position over and then along the cam profile 11. The cam follower 22 is held in a raised position by the cam profile 11 and prevents depression of the depressor means 17 and thus prevents activation of the sprayhead 1 This position is releasably retained by the action of locking ribs 25 interfering with snap-fittings 26 on the base 2.

As the top 3 is rotated, the opening 24 moves around with the top 3 until, in the completely closed position, the opening 24 corresponds to the outlet closure plate 10 and the fluid outlet 12 faces a section of the body portion 16 for complete closure of the fluid outlet 12. In this position, the sprayhead 1 is completely closed and cannot be activated inadvertently. The position is retained by the action of locking ribs 25 interfering with the snap fittings 27 on the base 2.

To open the sprayhead 1 for use, the top 3 is rotated in a reverse direction relative to the base 2 and the cam follower 22 moves along the cam profile 11 to a position in which the depressor means 17 can be depressed and the sprayhead 1 can be activated.

The invention provides a simple and easily operated self-closing sprayhead for aerosols and similar that can be used without having to have a separate lid or closure means provided.

What is claimed is:

1. A sprayhead comprising:

a support comprising a base and a top;

a passageway, mounted on the support, connectable to a switchable source of fluid and incorporating a fluid outlet, the passageway being moveable between a first, non-operative position and a second position in which it switches the source to supply fluid to the outlet via the passageway;

a member which is part of the support, the member being moveable between a first non-operative position when the member is supported by a cam means on the support, and a further position in which the passageway may switch the source to supply fluid; and a lock selectively operable to lock the member in its first position, said lock comprising snap-fittings attached to said base and locking ribs attached to said top, thereby preventing the member from urging the passageway to its second position unless the lock is released.

2. A sprayhead according to claim 1 wherein the fluid outlet is mounted on the support via a living hinge which is resiliently biased to urge the passageway to its first non-operative position.

3. A sprayhead according to claim 1 wherein the member is mounted on the support via a living hinge which is resiliently biased to urge the member to its non-operative position.

4. A sprayhead according to claim 1 wherein the shields the passageway such that the passageway may only be movable to its second position by movement of the member.

5. A sprayhead according to claim 1 wherein the support comprises a base and a top, the base being mountable on a fluid container and the top being mounted on the base.

6. A sprayhead according to claim 5 wherein the member is integrally formed with the top of the support.

7. A sprayhead according to claim 1 wherein the support comprises a base and a collar, the base being mountable on a fluid container and the collar being mounted around the base.

8. A sprayhead according to claim 5 wherein the lock comprises complementary cam means on the base and the top or collar such that movement of respectively the top or collar relative to the base moves the corresponding cam means relative to one another between a first position in which the member is retained in its inoperative position and a second position in which the member can be moved to urge the passageway to its second position.

9. A sprayhead according to claim 5 wherein the cam means comprises one of a cam profile and a cam follower on the base and the other of a cam profile or cam follower on respectively the top or collar.

10. A sprayhead according to claim 9 wherein the cam means on the base comprises a cam profile and the cam means on the top comprises a cam follower on the member.

11. A sprayhead according to claim 5, wherein the top is rotatable relative to the base.

12. A sprayhead according to claim 7 wherein the collar is rotatable relative to the base.

13. A sprayhead according to claim 11 wherein one of the top and base further comprises a tongue and the other of the top and base comprises a matching indentation, preventing relative rotation of the top and base when the tongue is located within the indentation.

14. A sprayhead according to claim 12 wherein one of the collar and base further comprises a tongue and the other of the collar and base comprises a matching indentation, preventing relative rotation of the collar and base when the tongue is located within the indentation.

15. A sprayhead according to claim 5 wherein the base comprises plastics material and is moulded in one piece.

16. A sprayhead according to claim 5, wherein the top comprises plastics material and is moulded in one piece.

17. A sprayhead according to claim 7 wherein the collar comprises plastics material and is moulded in one piece.

18. A sprayhead according to claim 5, wherein the top and base comprise cooperating fastening means that snap fit together.

19. A sprayhead according to claim 5, wherein the top comprises a body portion and the member comprises a cut-away portion linked to the body portion by a flexible hinge.

20. A sprayhead according to claim 5 wherein the top comprises an opening in the body portion for co-operation with the fluid outlet.

21. A sprayhead according to claim 5 wherein the member comprises catch means to prevent raising of the member with respect to the body portion of the top or the collar.

22. A sprayhead according to claim 1 wherein the base is non-rotatable axially relative to a fluid supply line from a fluid reservoir.

23. An aerosol container comprising a sprayhead according to claim 1.

24. A pumpspray container comprising a sprayhead according to claim 1.

25. A sprayhead comprising:

a support comprising a base and a collar;

a passageway, mounted on the support, connectable to a switchable source of fluid and incorporating a fluid outlet, the passageway being moveable between a first, non-operative position and a second position in which it switches the source to supply fluid to the outlet via the passageway;

a member secured relative to the support, the member being moveable between a first non-operative position when the member is supported by a cam means on the support, and a further position in which the passageway may switch the source to supply fluid; and a lock selectively operable to lock the member in its first position, send lock comprising snap-fittings attached to said base and locking ribs attached to said collar, thereby preventing the member from urging the passageway to its second position unless the lock is released.

* * * * *